US008474779B1

(12) United States Patent
Ronnkvist

(10) Patent No.: US 8,474,779 B1
(45) **Date of Patent: *Jul. 2, 2013**

(54) POST ANCHORING DEVICE AND RELATED METHODS

(71) Applicant: Thomas M. Ronnkvist, Minnetrista, MN (US)

(72) Inventor: Thomas M. Ronnkvist, Minnetrista, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/760,383

(22) Filed: Feb. 6, 2013

Related U.S. Application Data

(63) Continuation of application No. 13/113,817, filed on May 23, 2011, now Pat. No. 8,398,047.

(51) Int. Cl.
*A01K 97/10* (2006.01)

(52) U.S. Cl.
USPC ..... 248/533; 248/156; 248/530

(58) Field of Classification Search
USPC ..... 248/87, 156, 511, 530, 532, 533, 248/545; 135/15.1; 405/251
See application file for complete search history.

(56) References Cited

U.S. PATENT DOCUMENTS

| | | | |
|---|---|---|---|
| 3,606,222 | A | 9/1971 | Howard |
| 3,954,253 | A | 5/1976 | Morel et al. |
| 4,765,277 | A | 8/1988 | Bailey et al. |
| 4,850,564 | A | 7/1989 | Padin |
| 7,510,350 | B2 | 3/2009 | Ronnkvist |
| 7,568,679 | B2 | 8/2009 | Neusch |
| 7,874,528 | B2 | 1/2011 | Keller |
| 2001/0035201 | A1 | 11/2001 | Kuzmic |
| 2002/0066241 | A1 | 6/2002 | Johnson |
| 2009/0180838 | A1 | 7/2009 | Ronnkvist |

*Primary Examiner* — Gwendolyn Baxter
(74) *Attorney, Agent, or Firm* — Schroeder & Siegfried, P.A.

(57) ABSTRACT

A line post anchoring device for a roadway cable barrier system includes a lower helical anchor to which a detachable line post socket member is secured. The helical anchor and line post socket of each line post anchoring device have mating coupling sections that are preassembled and hydraulically screwed into the ground in a single operation. Each socket includes interior guide plates for properly guiding and positioning a line post therein, such that the cabling system can be effectively strung under tension at the same time the anchoring devices are installed in the ground. Damaged sockets are easily replaced with minimal disruption to the surrounding soil by backing the helical anchor out of the ground only so far as necessary to detach and replace the damaged socket, and then reinserting the helical anchor in the same location. There is no delay or multiple operations required for installation or repair, thus enhancing roadway safety by minimizing traffic disruptions and possible accidents incident thereto.

20 Claims, 8 Drawing Sheets

POST ANCHORING DEVICE AND RELATED METHODS

CROSS REFERENCE TO RELATED APPLICATIONS

This application is a continuation of U.S. patent application Ser. No. 13/113,817, filed on May 23, 2011, which claims the benefit of U.S. Provisional Application Ser. No. 61/360,964, filed on Jul. 2, 2010. The entire disclosures of each of the above applications are incorporated herein by reference.

BACKGROUND OF THE INVENTION

The present invention relates generally to the art of highway safety barriers and methods of installing same. More particularly, the present invention relates to cable barrier systems used along edges and in the medians between roadways and the like, and methods of erecting posts for installing such barriers and the like.

As the number of vehicles has increased on the roadways, so too has the risk of accidents. Consequently, concern over vehicle safety, as well as the safety of vehicle passengers and roadway workers, has also increased. As one means of protection, attempts have previously been made to erect safety barriers along the roadways and between medians of highways. These barriers help to prevent errant vehicles from leaving the roadway and/or crossing lanes into oncoming traffic, thus causing significant damage and/or injury to the property of others.

Early efforts in constructing such barriers consisted of erecting rows of concrete posts anchored to the ground adjacent the roadways. Eventually, this gave way to the erection of more continuous permanent concrete structures, and in cases where more temporary protection is required (e.g., roadway construction), the use of larger pre-cast concrete barriers that may be placed in position and reused as needed has become increasingly popular. While these more permanent massive concrete barriers are helpful in preventing vehicles from entering oncoming traffic lanes, they do not prevent vehicles from rebounding back into the original lane of traffic, and have been known to frequently cause more accidents in this manner.

Less permanent breakaway cable barrier systems are now available which help prevent out-of-control vehicles from entering oncoming traffic or rebounding into the original traffic lane. Such breakaway barrier systems have gained substantial popularity in recent years and are typically composed of a series of steel line-post cabling structures anchored within the ground with steel cables drawn therebetween under high tension. Such cable barrier systems offer high rupture strength, yet are more flexible to help prevent vehicle rebound, and are easier to install and repair when required.

In one known system, a socketed foundation with a concrete footing is installed for each line post along a roadway. A removable line post is then inserted within each socket and a steel cable is strung under tension therebetween. While effective, installing this system is complicated and time consuming. For each line post installed, significant time and labor is required to dig the footing hole, mix and pour concrete for the footing, and properly position and set the socket within the concrete to cure; this is all done on site. Each socketed foundation must then cure before the steel cabling system can be strung, thus requiring a separate operation. Moreover, most Department of Transportation (DOT) regulations now require the removal of all "spoils" caused by auguring the holes for the cement anchors, which adds additional time, cost and traffic disruption to the installation process. As is evident, multiple trips to the installation site result in increased installation time and consequent traffic diversion/stoppage. Importantly, it also significantly increases the potential for accident and injury to vehicles on the roadway, as well as the roadway workers installing such systems.

Other cabling systems utilizing pre-cast socketed concrete footings are also available, but such systems are less desirable in that they require larger holes to be dug for installation of the pre-cast footings, create more potential spoilage, and are less stable due to greater soil disruption. For proper installation, significant and time consuming packing of the soil around the pre-cast footing is required to stabilize each line post before stringing the cabling system. Still other cable barrier systems are presently available which utilize direct-driven line posts or sockets. While such systems are typically easier and less time consuming to install, again their anchoring systems are generally less stable and more prone to damage upon impact by a vehicle.

Upon such an impact by a vehicle, not only is damage typically caused to the vehicle and possibly the vehicle's passengers, but oftentimes the cable barrier system itself undergoes significant damage. In most cases, the cabling systems become damaged and the line posts are oftentimes bent severely beyond repair, thus requiring replacement. More significantly, however, is the fact that oftentimes the sockets that are fixed within the concrete footings are badly damaged and incapable of receiving another line post, or the concrete footing itself has been shifted out of proper alignment. In such cases, the entire footing must be removed and replaced because the damaged socket/concrete footing are fixed together as an integral unit. Such replacement causes a further significant disruption of the surrounding soil, thereby reducing the stability of the unit under repair. Obviously, such required frequent repairs are tedious, time consuming and expensive. More time is spent diverting and disrupting traffic flow, and the potential for accident and injury to others also increases.

BRIEF SUMMARY OF THE INVENTION

One principal object of the present invention is therefore to overcome the deficiencies of the safety barrier systems described above and provide an improved cable barrier system that is less time consuming and costly to install and/or repair.

Another object of the present invention is to enhance vehicle, passenger and road worker safety by providing a more efficient apparatus and method for installing and repairing roadway cable barrier systems that minimizes traffic disruption and the potential for injury incident thereto.

It is still a further object of the present invention to provide a roadway cable barrier system that is highly stable and that can be readily installed and repaired when necessary with minimal disruption to the stability and integrity of the surrounding soil and little or no soil spoilage, thereby enhancing the stability of the cable barrier system.

The foregoing objects and others are achieved through use of the present invention, in which the anchoring device utilized for each line post of the cable barrier system is comprised of a helical anchor that may be readily installed with no need for the tedious and time consuming use of concrete footings. An example of one such helical anchor is shown and described in my earlier U.S. Pat. No. 7,510,350, the contents of which are incorporated herein by reference thereto. Such helical anchors may be hydraulically screwed into the ground to a predetermined level of torque required to ensure maximum stability. Depending on the soil conditions present at the job site, the depth of the anchor may be adjusted accordingly to meet the desired stability requirements and establish the desired height of the line post during installation. Moreover, by utilizing such helical anchors, minimal disturbance of the surrounding earth occurs as the anchors displace only so much of the ground as necessary to be screwed in place, thus increasing the anchor's stability and minimizing the need for removal of costly spoils caused by auguring holes for concrete footings.

Secured to the upper end of the helical anchoring device during installation is a readily detachable and removable socket member, the interior of which is adapted to receive a conventional line post for a cable barrier system. Although the necessary strength of the anchor and socket member will be largely dictated by the particular application requirements, and may vary accordingly, in one exemplary embodiment it is contemplated that the helical anchor and removable socket may be formed with hardened alloy steel coupling sections that are adapted to mate in a manner as more fully disclosed in my aforementioned U.S. Pat. No. 7,510,350. In so doing, added protection against possible damage from vehicle impact is provided to the area of the helical anchor/socket coupling joint. Thus, each combined helical anchor and removable socket may be hydraulically screwed into the ground as necessary to reach the desired stability and align the top of the line post socket member at or near ground level. Installation of the helical anchors with removable sockets, and stringing the cabling system, may therefore be accomplished expeditiously without the need for multiple operations, as required with the use of concrete footings. This results in a significant reduction in traffic disruptions/delays, thereby reducing the likelihood of accidents and enhancing the safety of our roadways.

Even more advantageously, in the event one or more line posts and sockets are damaged as a result of vehicle impact, the readily detachable socket utilized in the present cable barrier system may be easily and efficiently removed and replaced without significant delay. To replace a damaged socket, the helical anchor may simply be backed out of the ground only so far as necessary to detach and replace the damaged socket, and then reinserted in the same location. The ground adjacent the helical anchor essentially remains undisturbed, thereby retaining desired anchor stability without having to install a new anchor and with no new soil spoils to clean up.

Unlike conventional cable barrier systems utilizing concrete footings, the socket of the present system is not permanently affixed (e.g., cemented) to the anchoring system. Consequently, upon damage to a line post socket, multiple operations of digging the old concrete footing out and resetting/curing a new concrete footing are avoided, and the earth surrounding the anchor is left essentially undisturbed so as not to jeopardize stability of the anchoring system and without creating additional spoils. Repairs are therefore more efficient, resulting in significant savings in time and cost. Moreover, traffic disruptions and consequently the likelihood of accidents while conducting required repairs are significantly reduced, thereby enhancing the safety of our roadways.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1A:
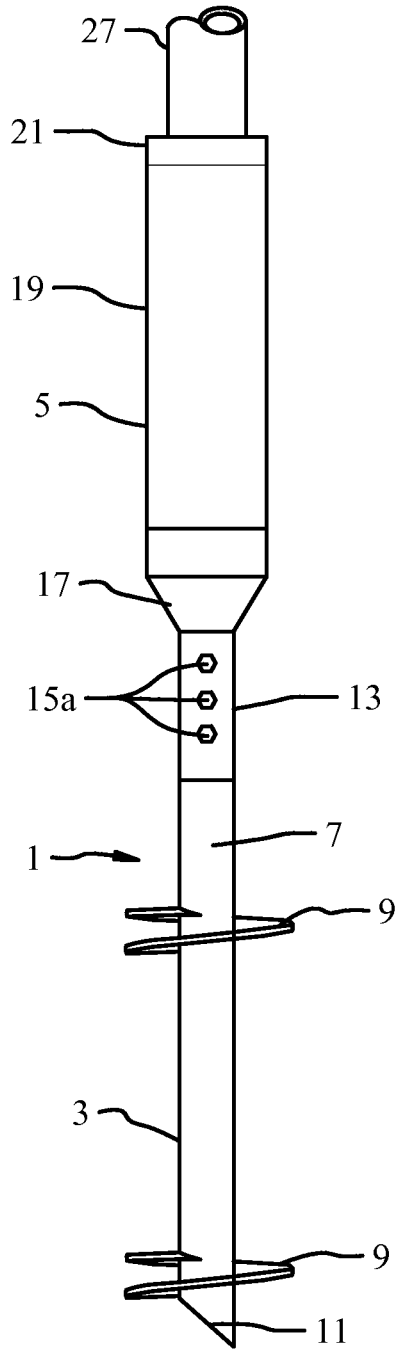
FIG. 1A is a side elevational view of a cable barrier post anchoring apparatus constructed in accordance with the present invention.

As shown in FIG. 1A, in accordance with the present invention, a line post anchoring device 1 for a cable barrier system is shown. The anchoring device 1 is comprised generally of a lower helical anchor 3 to which a detachable line post socket member 5 is secured. The helical anchor 3 includes in general a main tubular drive shaft section 7 to which one or more helical flights or plates 9 are permanently affixed, as by welding. The lower end of drive shaft 7 tapers to a point 11 to facilitate penetration of the ground upon insertion of the anchor 3. Point 11 may take the form of and be constructed in any of a variety of ways, but in the preferred embodiment shown in FIG. 1A, it is formed by cutting the lower end of the drive shaft 7 at about a forty-five (45) degree angle, and leaving the end hollow.

Flights 9 are helically shaped to cause anchor 3 to be screwed into the ground upon rotation of the drive shaft 7. Each flight 9 secured to the main drive shaft section 7 may optionally increase in diameter as the distance from point 11 increases. As shown in FIG. 1A, and as a general rule, the helical flights 9 are typically spaced along drive shaft 7 at intervals of about two (2) to three (3) times the diameter of the next lower flight. Although the thickness of flights 9 may vary depending on the size of the flight and the application involved, generally speaking, it is contemplated that such flights may be approximately ⅜" thick.

Although the necessary strength of the anchor 3 and socket member 5 will be largely dictated by the particular requirements of each specific application, and may vary accordingly, in one exemplary embodiment, helical anchor 3 and flights 9 welded thereto are constructed of galvanized hardened alloy steel to prevent corrosive deterioration of the anchor over time. In another exemplary embodiment, the main drive shaft section 7 may be constructed from hot-finished normalized seamless alloy steel tubing, so as to eliminate the possibility of any cracking or rupturing of the longitudinal weld associated with other conventional welded hot or cold rolled tubing. In still another embodiment, in order to strengthen the helical anchor 3 further, the main drive shaft section 7 and flights 9 may be constructed of normalized alloy steel having a carbon composition in excess of approximately 0.25% by weight, and heat-treated to a yield and tensile strength of approximately 80,000 psi.

Figure 1B:
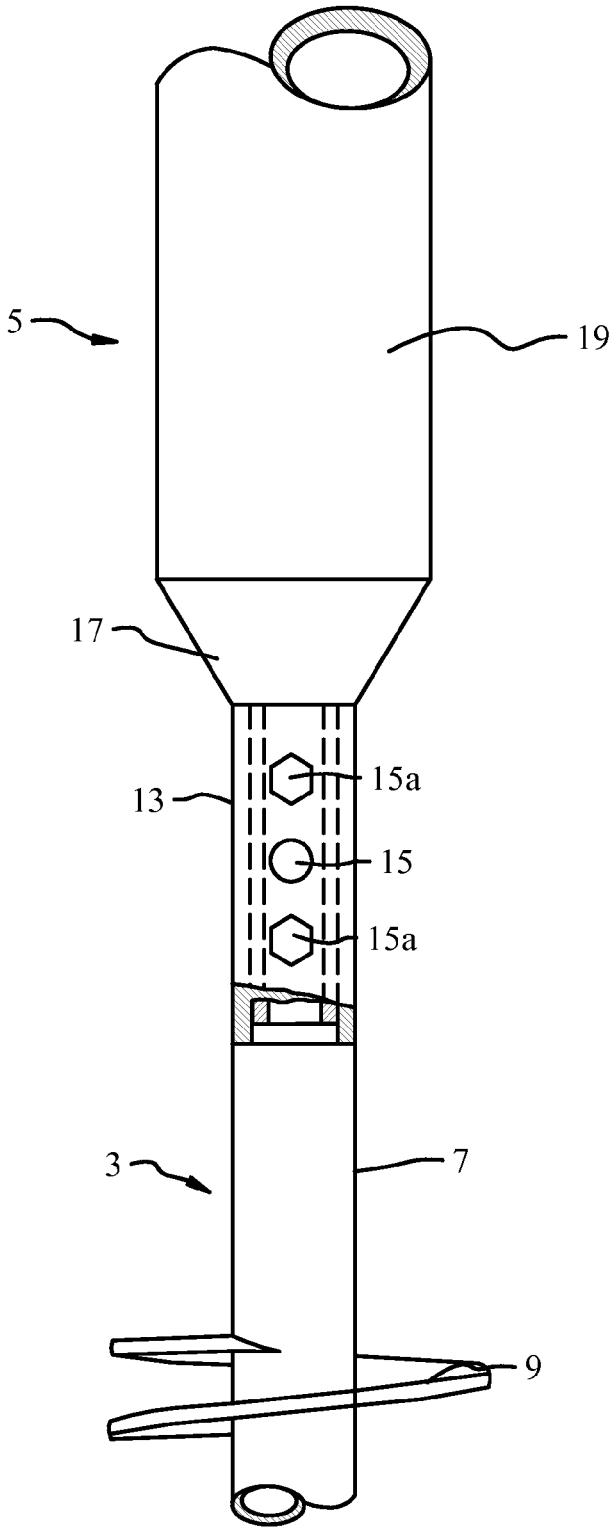
FIG. 1B is an enlarged partially sectioned side elevational view of the joint between the helical anchor and line post socket member which comprise the anchoring apparatus shown in FIG. 1A, showing the engagement of corresponding male and female coupling sections thereof.

Although it is contemplated that drive shaft section 7 could be constructed homogeneously throughout of the same material, as shown in FIGS. 1A and 1B, in another exemplary embodiment the upper torque-receiving end of drive shaft 7 may be constructed to carry an integrally formed steel coupling section 13, the material composition of which may or may not be the same as shaft section 7. Although not typically required, in one alternative embodiment, it is contemplated that coupling section 13 may optionally be hardened for added strength in the manner disclosed in my earlier U.S. Pat. No. 7,510,350, the contents of which have been incorporated herein by reference thereto.

The coupling section 13 may be fused to the upper end of the anchor's main drive shaft section 7 by welding the same thereto. Although not deemed necessary for the purposes of the present application, if added strength is desirable, the process of inertia friction welding coupling section 13 to the shaft section 7 may also be utilized. In the case where coupling section 13 is hardened relative to shaft section 7, inertia friction welding the coupling section 13 and drive shaft 7 together creates a fused joint between the two adjoining materials which is even stronger than that of the remainder of the drive shaft.

As best illustrated in FIG. 1B, coupling section 13 is in the form of a female coupling element, but it is certainly contemplated that it may take the form of a male coupling element without departing from the scope of the invention herein. The drive shaft 7 and integral coupling section 13 are both fully galvanized to prevent corrosion and consequent deterioration of the anchor 5. At least a pair of pre-drilled bolt holes 15 extends transversely through coupling section 13 to accommodate bolts 15*a* and facilitate attachment of additional extension shafts and/or the line post socket member 5, which will be described in more detail hereafter.

Figure 2A:
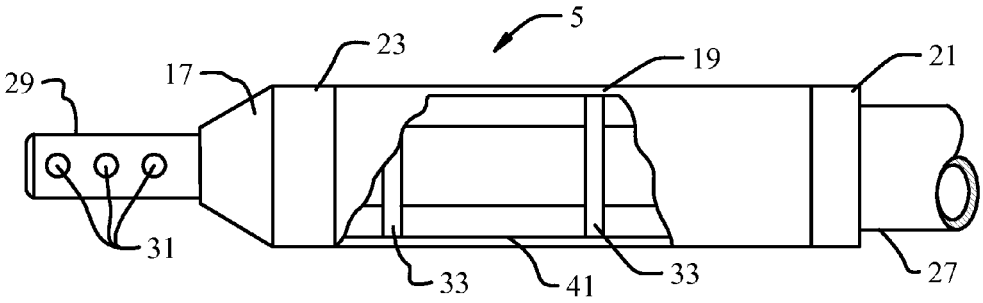
FIG. 2A is a side elevational view of the line post socket member of the cable barrier post anchoring apparatus shown in FIG. 1A, with portions broken thereof away to disclose the internal guide plates for guiding and positioning a line post therein.
Figure 2B:
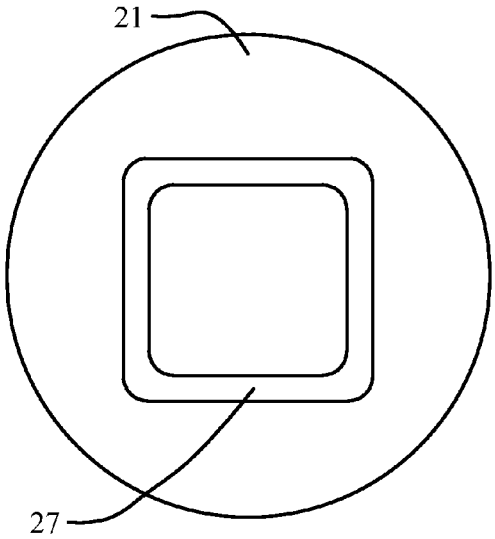
FIG. 2B is a top plan view of the line post socket member shown in FIG. 2A.

As illustrated in FIG. 2A, the detachable line post socket member 5 is comprised generally of a coupling section 17, an intermediate tubular main body section 19, and a terminal end cap or cover section 21, all of which may be constructed of galvanized hardened alloy steel if deemed necessary to prevent corrosive deterioration of the socket 5 over time. The relative strength and hardness of the socket member 5 is expected to vary depending on the application involved and/or applicable government safety requirements or regulations of the DOT for each specific project involved.

Figure 3:
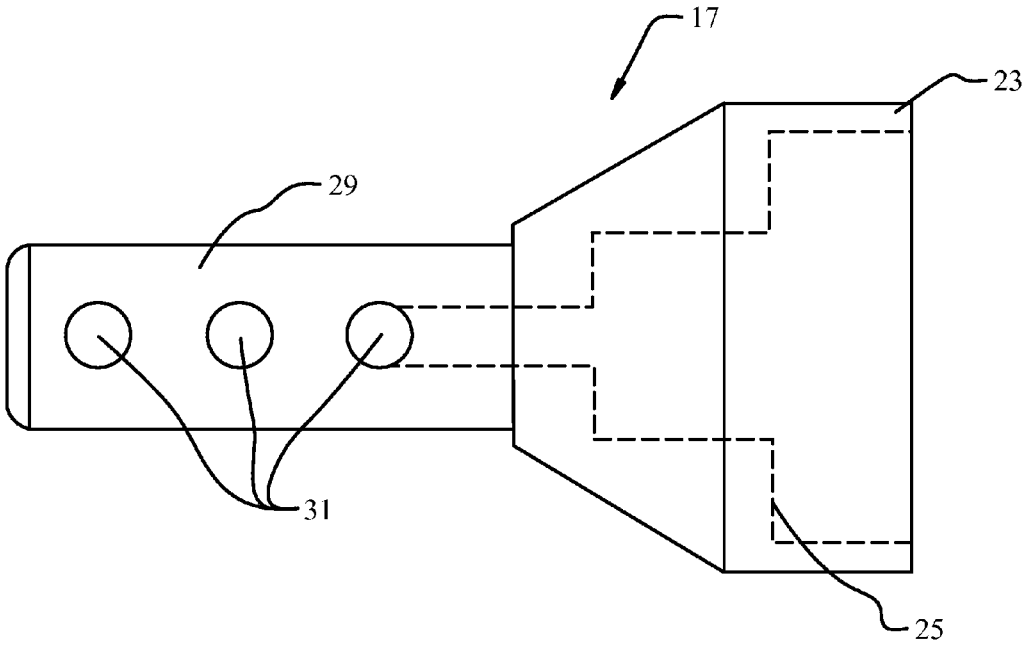
FIG. 3 is a side elevational view of the coupling section of the line post socket member shown in FIG. 2, with broken lines lines depicting the interior wall structure thereof.

The abutment end portion 23 of coupling section 17 is generally tubular in construction with inner and outer diametrical dimensions substantially the same as that of the main body section 19 of the socket member 5. As seen best in FIG. 3, an interior shoulder 25 (shown in broken lines) is formed within the abutment end portion 23 of coupling section 17, which functions as a stop for the insertion of line post 27 within socket 5. In a manner similar to coupling section 13, coupling section 17 may be welded to the main body section 19 of socket member 5. Although not deemed necessary in the present application, for added strength, the process of inertia friction welding may also be utilized to fuse coupling section 17 to the main body section 19 of socket 5.

Coupling section 17 tapers radially inward from the abutment end portion 23 to a terminal male coupling element 29. As best shown in FIG. 1B, the male coupling element 29 is constructed to be cooperatively received within and mate with the female coupling section 13 of the helical anchor 3. A set of pre-drilled bolt holes 31 extend transversely through the male coupling element 29 so as to cooperatively align with bolt holes 15 in the female coupling section 13 of helical anchor 3. A set of readily removable bolts 15*a* may then be inserted through the mating coupling sections 13 and 17 and tightened to securely connect the socket member 5 to the helical anchor 3 of the line post anchoring device 1.

Figure 4A:
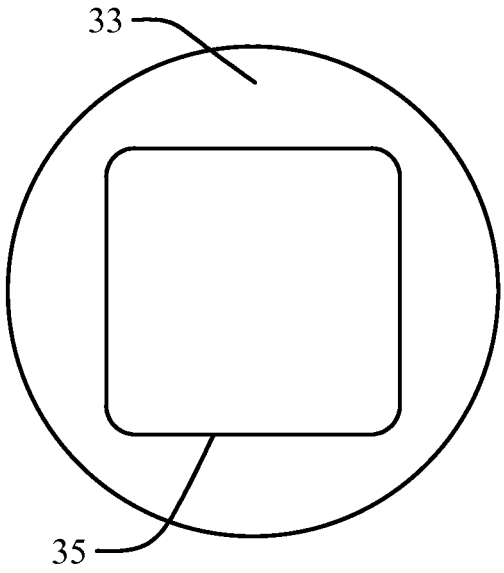
FIG. 4A is a top plan view of one of the line post guide plates that are secured to the interior wall of the line post socket member shown in FIG. 2A.
Figure 4B:
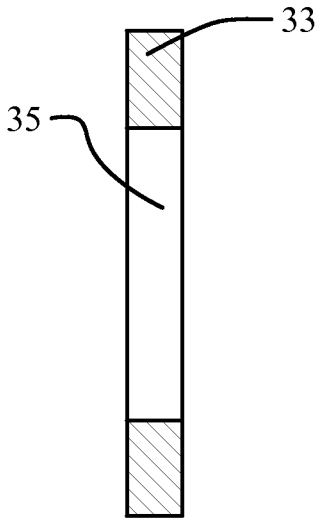
FIG. 4B is a cross-sectional view of one the line post guide plates that are secured to the interior wall of the line post socket member shown in FIG. 2A.

As shown best in FIG. 2A, welded securely within the internal cavity of the tubular body section 19 of socket member 5 is a plurality of guide plates 33, which function to guide line post 27 into proper supported position within socket member 5. As shown, guides plates 33 are welded in spaced relation along the interior wall 41 of the main body section 19, so as to provide ample guidance and support of the line post 27. As best shown in FIGS. 4A and 4B, guide plates 33 are each configured with an interior opening 35 that is cooperatively sized and shaped to correspond with the cross-sectional configuration of the line post 27 to be inserted within socket 5. Each opening 35 is sized just slightly larger than the outer circumferential dimensions of the line post 27 to be used, so as to allow guided passage thereof through opening 35. In the present case, opening 35 is depicted as having a generally square configuration, but it will be appreciated that the size and shape of opening 35 will be dictated by the cross-sectional configuration of the line post 27 being used for each given cable barrier project, and may vary accordingly. It will be readily appreciated that the openings 35 in guide plates 33 may be readily modified to adapt to all available sizes and configurations of line posts 27, or tubular section 19 may be otherwise adapted to conform to the proper size and shape of the line posts 27 being utilized.

Figure 5A:
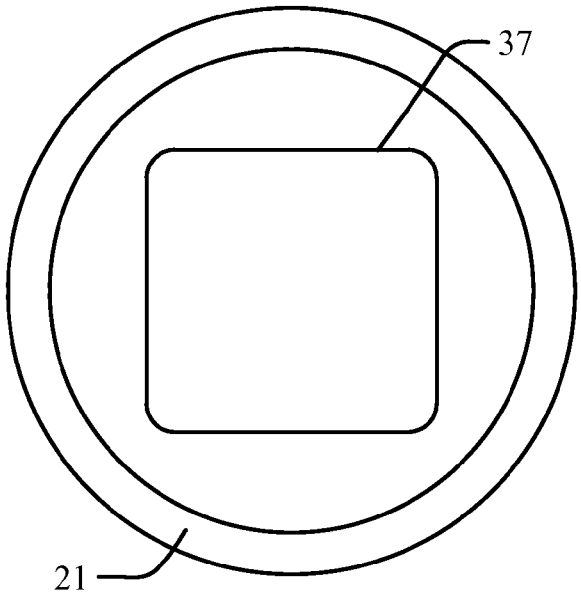
FIG. 5A is a bottom plan view of the cap section of the line post socket member shown in FIG. 2A.
Figure 5B:
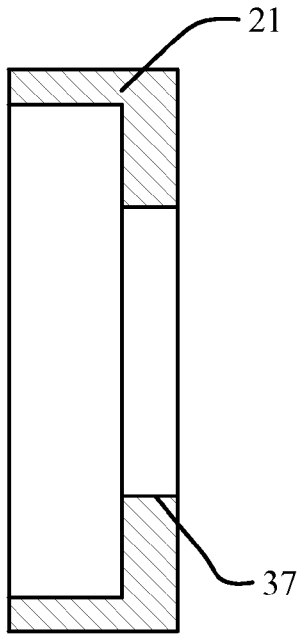
FIG. 5B is a cross-sectional view of the cap section of the line post socket member shown in FIG. 2A.

As seen in FIG. 2A, the terminal cap 21 carried at the upper end of socket 5 is constructed with an outer wall structure that cooperatively interfaces with the wall structure of main body section 19 so as to facilitate welding the cap section 21 thereto. As best shown in FIGS. 5A and 5B, cap 21 also includes a central opening 37 cooperatively sized just slightly larger than the outer circumferential dimensions of the line post 27 to be used, which further facilitates guidance and support of the line post 27 when inserted therein. In the present case, opening 37 in cap 21 is depicted as having a generally square configuration similar to the opening 35 in guide plates 33, but it will be appreciated that the size and shape of opening 37 may vary in accordance with the cross-sectional configuration of the line post 27 being used for each given cable barrier project. It will also be readily appreciated that opening 37 in cap 21, like the openings 35 in the guide plates 33, may be readily modified to adapt to all available sizes and configurations of line posts 27, or tubular section 19 may be otherwise adapted to conform to the proper size and shape of the line posts 27 being utilized.

Although it is contemplated that socket member 5 could be constructed homogeneously throughout of the same material, as in the case of coupling section 13, it is also contemplated that any one or more of the socket sections 17, 19 or 21 may or may not have the same composition as the others. For example, it is contemplated that coupling section 17 may optionally be constructed in a manner similar to the coupling sections disclosed in my earlier U.S. Pat. No. 7,510,350 (i.e., coupling section 17 may be formed of a hardened steel having an increased carbon content and higher yield and tensile strength than the remainder of the material from which socket 5 is constructed). In such case, inertia friction welding may also be optionally utilized to weld coupling section 17 and main body section 19 of the socket 5 together, thereby creating a fused joint between the two adjoining materials which is even stronger than that of the remainder of socket 5.

Figure 6A:
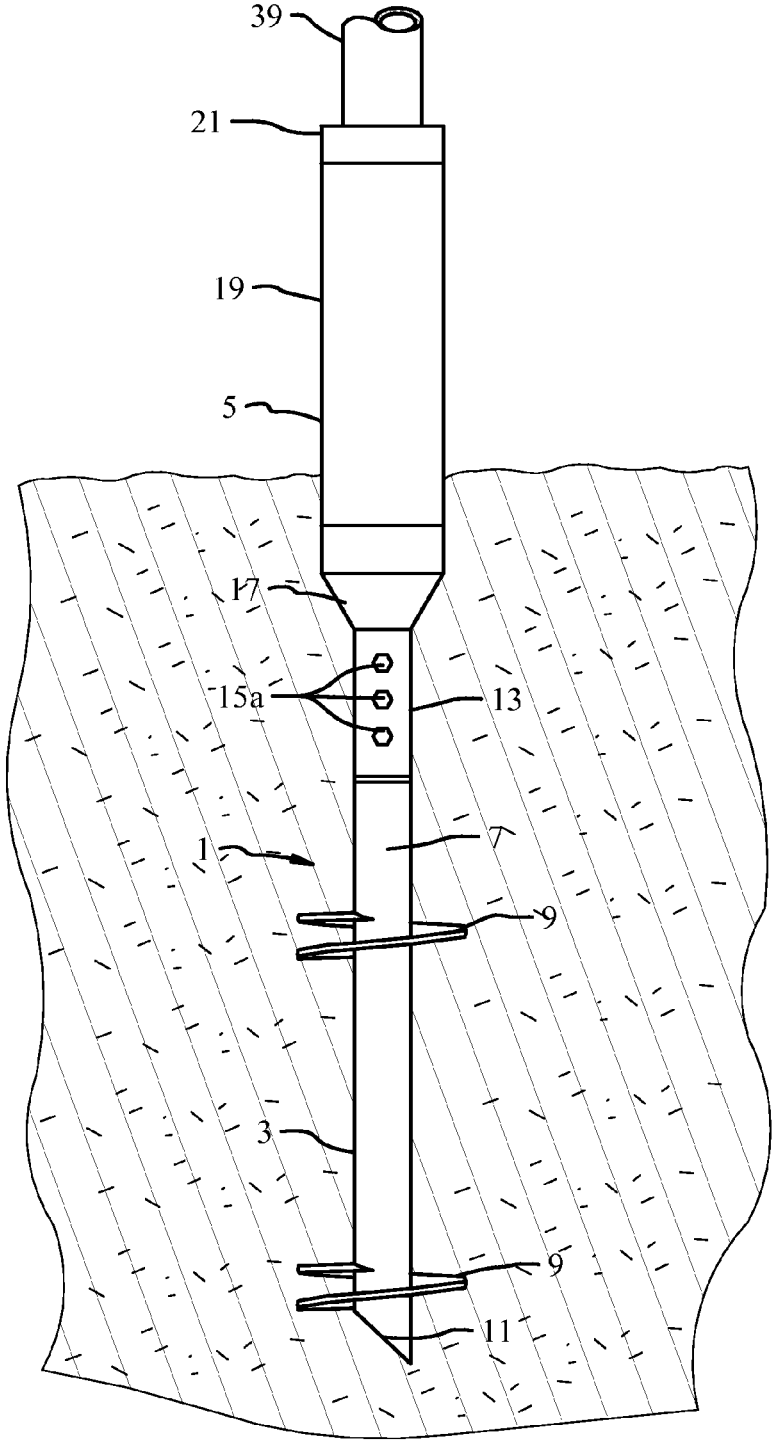
FIG. 6A is an elevational view of the cable barrier post anchoring apparatus of FIG. 1A, showing the manner in which it may be installed within the ground.
Figure 6B:
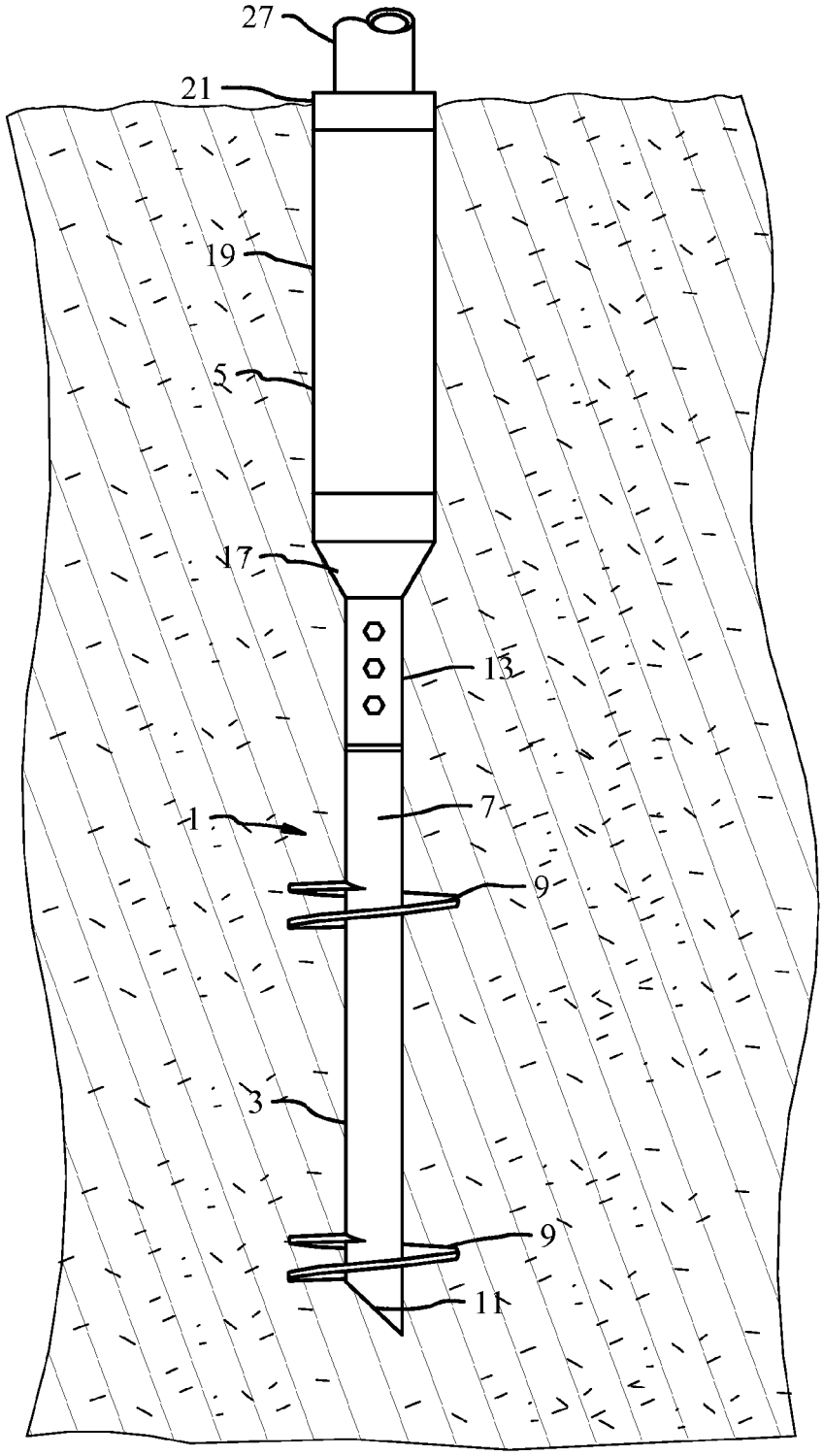
FIG. 6B is an elevational view of the cable barrier post anchoring apparatus shown in FIG. 1A after installation with a line post inserted therein.

In use, each line post anchoring device 1 may be assembled by connecting a removable socket 5 to a helical anchor 3 in the manner as previously described herein. As best shown in FIGS. 6A and 6B, once assembled, the line post anchoring device 1 may be hydraulically screwed into the ground as necessary to reach the desired stability and align the top of the line post socket member 5 at or near ground level. This may be accomplished using a relatively small skid loader or track loader (not shown) to which a hydraulic drive means may be mounted, thus avoiding the need for large cement trucks or other vehicles that may block traffic and cause delays and possible accidents. As shown in FIG. 6A, the hydraulic drive apparatus may be fitted with a drive shaft 39 corresponding in size and shape to that of the line post 27 to be used for a given project, such that the drive shaft 39 may be inserted within the socket 5 to screw the anchoring device 1 into the ground. Any suitable connecting mechanism, such as a bolt (not shown), may be used to prevent the line post anchoring device from slipping off the hydraulic drive shaft during installation.

Screwing the helical anchor 3 of each line post anchoring device 1 into the ground causes minimal disturbance of the surrounding earth, thereby increasing the anchor's stability and minimizing the need for removal of costly spoils caused by auguring holes for concrete footings. As shown in FIG. 6B, once installed, a line post 27 may be inserted into each socket 5 and through guide plates 33 for proper seating against stop 25. The cabling system may then be strung without delay in a conventional manner well known in the art. There is no need to wait for concrete footings to cure; consequently, there is no need for multiple operations to install the cable barrier system. Installation of multiple line post anchoring devices 1 with removable sockets 5, and stringing the cabling system, may therefore be accomplished expeditiously without the need for multiple trips to the job site, thus significantly reducing traffic disruptions and the likelihood of accidents occurring as a result thereof.

In the event one or more of the line posts 27 and sockets 5 break off or become damaged as a result of vehicle impact, the readily detachable socket 5 utilized in the present cable barrier system may be easily and efficiently removed and replaced without significant delay. Unlike conventional cable barrier systems utilizing concrete footings, the socket 5 of the present system is not permanently affixed (e.g., cemented) to the anchoring system. Consequently, upon damage to a line post socket 5, multiple operations of digging the old concrete footing out and resetting/curing a new concrete footing are avoided, and the earth surrounding the anchor 3 is left essentially undisturbed so as not to jeopardize stability of the anchoring system.

To replace a damaged socket 5, the helical anchor 3 may simply be backed out of the ground only so far as necessary to detach and replace the damaged socket 5, and then hydraulically reinserted in the same location using the method described above. The ground adjacent the helical anchor 3 remains essentially undisturbed, thereby retaining desired anchor stability without having to install a new anchor. The damaged socket 5 may be replaced anew and the cabling system restrung in a single operation, without the need to wait for concrete to cure. Repairs are therefore more efficient, resulting in significant savings in time and cost. Moreover, traffic disruptions and the likelihood of accidents occurring while conducting required repairs are significantly reduced, thereby enhancing the safety of our roadways.

It will, of course, be understood that various changes may be made in the form, details, arrangement and proportions of the parts without departing from the scope of the invention which comprises the matter shown and described herein and set forth in the appended claims.

The invention claimed is:

1. A post anchoring device, comprising:

(a) a post having a non-circular cross-sectional configuration;

(b) a ground anchoring member having a main drive shaft section and a terminal coupling section, said main drive shaft section including a plurality of helically-shaped external plates secured at spaced intervals thereto;

(c) a tubular socket member having opposite ends and an internal cavity adapted to slidably receive at least a portion of said post therein;

(d) one of said ends of said socket member having non-circular opening-defining portions configured to receive and guide said post within said internal cavity of said socket member, and the opposite of said ends of said socket member being secured in readily detachable and removable relation to said coupling section of said ground anchoring member; and (e) a support member affixed to an interior surface of said tubular socket member, said support member having non-circular opening-defining portions through which said post extends in supported and guided relation.

2. The post anchoring device defined in claim 1, including a torque drive member having a non-circular cross-sectional configuration adapted to mate with said opening-defining portions of said tubular socket member for rotatably driving said anchoring member and said socket member into the ground.

3. The post anchoring device defined in claim 1, wherein said opening-defining portions of said tubular socket member have the same cross-sectional configuration as said post.

4. The post anchoring device defined in claim 1, wherein said opening-defining portions of said support member have the same cross-sectional configuration as said post.

5. The post anchoring device defined in claim 1, wherein said support member comprises a plate mounted within said internal cavity, and said opening-defining portions in said support member is shaped substantially the same as the cross-sectional configuration of said post.

6. The post anchoring device defined in claim 1, wherein said socket member includes a terminal end cap, said opening-defining portions of said socket member extending through said end cap and being shaped substantially the same as the cross-sectional configuration of said post.

7. The post anchoring device defined in claim 6, wherein the shape of the opening-defining portions extending through said cap is different from the shape of said internal cavity of the remainder of said socket member.

8. The post anchoring device defined in claim 1, wherein said socket member includes a terminal coupling section adapted to mate with said terminal coupling section of said ground anchoring member, said terminal coupling section of at least one of said ground anchoring member and said socket member being formed of a hardened material having a yield and tensile strength exceeding that of the remainder thereof.

9. The post anchoring device defined in claim 8, wherein said terminal coupling section formed of a hardened material is inertia friction welded to the remainder of said ground anchoring member or said socket member to which it is connected.

10. The post anchoring device defined in claim 9, wherein said ground anchoring member and said socket member are formed of a galvanized steel, and said terminal coupling section of each of said ground anchoring member and said socket member has an increased carbon content and higher yield and tensile strength than the remainder thereof.

11. The post anchoring device defined in claim 1, wherein said socket member includes a shoulder member extending radially inward into said internal cavity so as to form a stop against which said post rests upon insertion therein.

12. The post anchoring device defined in claim 1, wherein said socket member includes a terminal coupling section having a greater diameter than said terminal coupling section of said ground anchoring member, said terminal coupling section of said socket member being constructed to taper diametrically to mate with said terminal coupling section of said ground anchoring member.

13. A post anchoring device, comprising:

(a) a post having a non-circular cross-sectional configuration;

(b) a ground anchoring member having a main drive shaft section and a terminal coupling section, said main drive shaft section including a plurality of helically-shaped external plates secured at spaced intervals thereto;

(c) a tubular socket member having opposite ends and an internal cavity adapted to slidably receive at least a portion of said post therein;

(d) one of said ends of said socket member having non-circular opening-defining portions matching the cross-sectional configuration of said post and configured to receive and guide said post therethrough, the opposite of said ends of said socket member being secured in readily detachable non-threaded relation to said coupling section of said anchoring member;

(e) a support member affixed to an interior surface of said tubular socket member, said support member having non-circular opening-defining portions through which said post extends in supported and guided relation; and (f) a torque drive member having a non-circular cross-sectional configuration adapted to mate with said opening-defining portions of said tubular socket member for rotatably driving said anchoring member and said socket member into the ground.

14. The post anchoring device defined in claim 13, wherein said opening-defining portions of said support member have the same cross-sectional configuration as said post.

15. The post anchoring device defined in claim 13, wherein said socket member comprises a terminal end cap affixed to said socket member, said opening-defining portions of said socket member extending through said cap.

16. The post anchoring device defined in claim 15, wherein the shape of the opening-defining portions extending through said cap is different from the shape of said internal cavity of the remainder of said socket member.

17. The post anchoring device defined in claim 13, wherein said socket member includes a terminal coupling section adapted to mate with said terminal coupling section of said ground anchoring member, said terminal coupling section of said ground anchoring member and said socket member being formed of a hardened material having a yield and tensile strength exceeding that of the remainder thereof.

18. The post anchoring device defined in claim 17, wherein said terminal coupling sections of said ground anchoring member and said socket member are inertia friction welded thereto.

19. The post anchoring device defined in claim 13, including a plurality of said support members affixed to said interior surface of said socket member and intermediately spaced between said opposite ends thereof.

20. A post anchoring system, comprising:

(a) a plurality of ground anchoring members disposed in spaced relation to one another, each of said ground anchoring members having a main drive shaft section and a terminal coupling section, said main drive shaft section of each of said anchoring members including a plurality of helically-shaped external plates secured thereto;

(b) a plurality of tubular socket members each having opposite first and second coupling ends, said first coupling end of each of said socket members being secured in readily detachable non-threaded relation to said coupling section of one of said anchoring members, and said second coupling end of each of said socket members being configured for connection to a torque drive member for rotating each of said socket members and said coupled anchoring members into the ground;

(c) each of said socket members and said coupled anchoring members being drivingly positioned in the ground with said second coupling end substantially flush with ground level, and said second coupling end of each of said socket members having opening-defining portions leading to an internal cavity within said socket member;

(d) a plurality of posts, at least a portion of each of said posts being slidably received in guided relation through said opening-defining portions and into said internal cavity of one of said socket members; and (e) steel cabling strung between and tautly connected to each of said posts.

* * * * *